US009205550B2

(12) United States Patent
Sze

(10) Patent No.: US 9,205,550 B2
(45) Date of Patent: Dec. 8, 2015

(54) COMBINED SCREWDRIVER HEAD ACCOMMODATING DEVICE

(71) Applicant: Talent Key Holdings Limited, Hong Kong (HK)

(72) Inventor: Wai Po Sze, Hong Kong (HK)

(73) Assignee: TALENT KEY HOLDINGS LIMITED, Hong Kong (HK)

( * ) Notice: Subject to any disclaimer, the term of this patent is extended or adjusted under 35 U.S.C. 154(b) by 0 days.

(21) Appl. No.: 14/516,614

(22) Filed: Oct. 17, 2014

(65) Prior Publication Data

US 2015/0197004 A1 Jul. 16, 2015

(30) Foreign Application Priority Data

Jan. 14, 2014 (HK) ..... 14100385

(51) Int. Cl.
*B65D 1/30* (2006.01)
*B25H 3/00* (2006.01)

(52) U.S. Cl.
CPC ..... *B25H 3/003* (2013.01)

(58) Field of Classification Search
CPC ..... B25H 3/003; B65D 1/30
USPC ..... 206/379, 377, 372, 373
See application file for complete search history.

(56) References Cited

U.S. PATENT DOCUMENTS 2,451,519 A * 10/1948 Studler ..... F42B 39/08 89/35.01
3,004,270 A * 10/1961 Cowley ..... B23G 5/04 206/372
3,521,785 A * 7/1970 Soelter ..... B01L 3/5082 211/74
3,564,662 A * 2/1971 Dold ..... A61B 19/0248 206/370
4,410,095 A * 10/1983 Dembicks ..... A47F 5/08 211/70.6
4,770,297 A * 9/1988 Chang ..... B65D 85/28 206/379
4,815,625 A * 3/1989 Filhol ..... B65D 1/30 206/443
4,880,122 A * 11/1989 Martindell ..... B25H 3/003 206/374
4,909,386 A * 3/1990 Jeffers ..... B25H 3/003 206/379
5,368,164 A * 11/1994 Bennett ..... B25H 3/003 206/373

(Continued)

FOREIGN PATENT DOCUMENTS

JP 2009034793 A 2/2009

OTHER PUBLICATIONS

Search Report of counterpart Hong Kong Short-term Patent Application No. 14100385.7 issued on Dec. 6, 2013.

*Primary Examiner* — Steven A. Reynolds
*Assistant Examiner* — King M Chu

(57) ABSTRACT

The present invention relates to a combined screwdriver head accommodating device, which comprises at least two screwdriver heads and an accommodating device used for the screwdriver heads, wherein the screwdriver head comprises a working portion, a transition portion and a clamping portion; the two ends of the transition portion are connected with the working portion and the clamping portion respectively; the transition portion is provided with an accommodating portion recessed inwardly along a radial direction; the accommodating device comprises at least two accommodating loops and a connector connecting the at least two accommodating loops; the accommodating loops are configured to be installed in the accommodating portions of the screwdriver heads; and the connector is formed by at least one slice. Through implementing the combined screwdriver head accommodating device, users may identify, store and replace the screwdriver head more conveniently, and easily identify old and new screwdriver heads.

8 Claims, 5 Drawing Sheets

(56) References Cited

U.S. PATENT DOCUMENTS 5,503,288 A * 4/1996 Conconi ..... B65D 21/0204 220/23.4
5,512,165 A * 4/1996 Liu ..... B25H 3/025 206/234
5,595,294 A * 1/1997 McKenzie ..... B25H 3/021 206/349
5,692,656 A * 12/1997 Dembicks ..... A47F 7/0028 206/377
5,767,433 A * 6/1998 Bill ..... F42B 33/00 206/3
5,855,285 A * 1/1999 Laird ..... B25H 3/003 206/378
6,047,827 A * 4/2000 Huang ..... B25H 3/003 206/349
6,109,569 A * 8/2000 Sakaida ..... F16L 3/222 248/316.7
6,112,897 A * 9/2000 Hu ..... B25H 3/003 206/372
6,702,642 B1 * 3/2004 Parein ..... A63H 33/08 446/105
6,932,223 B1 * 8/2005 Lee ..... B25H 3/04 206/349
6,991,103 B2 * 1/2006 Chen ..... B25H 3/003 206/373
7,185,770 B1 * 3/2007 Roten ..... A47B 81/00 211/70.6
8,261,782 B2 * 9/2012 Fredette ..... F16N 31/004 141/314
2002/0179473 A1 * 12/2002 Chao ..... B25H 3/003 206/379
2004/0163983 A1 * 8/2004 Chang ..... B25H 3/003 206/377
2004/0206649 A1 * 10/2004 Chen ..... B25F 5/029 206/379
2006/0283769 A1 * 12/2006 Roesler ..... B25H 3/023 206/588
2007/0138043 A1 * 6/2007 Roesler ..... B25H 3/003 206/379
2007/0235360 A1 * 10/2007 Lin ..... B25H 3/025 206/373
2010/0012539 A1 * 1/2010 Wang ..... B25H 3/003 206/379
2010/0122926 A1 * 5/2010 Tocco ..... B23B 31/1071 206/379
2011/0192746 A1 * 8/2011 Chang ..... B65D 25/22 206/379

* cited by examiner

COMBINED SCREWDRIVER HEAD ACCOMMODATING DEVICE

CROSS REFERENCE TO RELATED APPLICATIONS

The present invention claims the benefit of Hong Kong Short-term Patent Application No. 14100385.7 filed on 14 Jan. 2014, the disclosure of which is incorporated herein in its entirety by reference.

FIELD OF THE INVENTION

The present invention relates to a combined screwdriver head accommodating device.

BACKGROUND

An existing screwdriver head only comprises a working portion and a clamping portion in general, which is independent. When screwdriver heads of different types and different sizes are required, a user can only rummage in a messy toolbox, thus wasting time and labor Furthermore, packages of the existing screwdriver heads generally refer to simple and easy packaging bags or boxes accompanied while purchasing, in which a plurality of independent screwdriver heads are accommodated in bulk within these packaging bags or boxes. When a lots of screwdriver heads are stored, the user usually accommodates them into a large toolbox, which makes it very troublesome to find out one suitable screwdriver head. In addition, when replacing a new screwdriver head, the user often directly puts the old one into the box of the new screwdriver head, so that the user does not know which one is new and which is used; meanwhile, it also causes confusion to the user, which makes it more difficult to find out the right one.

Therefore, a combined screwdriver head accommodating device is need to meet different requirements of the user, so that it is very convenient for the user to replace as well as to identify and store the new and old screwdriver heads.

SUMMARY

One objective of the invention is to provide a combined screwdriver head accommodating device which is convenient for a user to identify and store screwdriver heads. The combined screwdriver head accommodating device comprises at least two screwdriver heads and an accommodating device used for the screwdriver heads. The screwdriver head comprises a working portion, a transition portion and a clamping portion. The two ends of the transition portion are connected with the working portion and the clamping portion respectively. The transition portion is provided with an accommodating portion recessed inwardly along a radial direction. The accommodating device comprises at least two accommodating loops and a connector connecting the two accommodating loops. The accommodating loops are configured to be installed in the accommodating portions of the screwdriver heads. The connector is formed by one or at a plurality of slices which are spaced mutually. As an improvement scheme, two opposite edges of a non-connecting part of each slice are provided inwardly with a V-shaped opening respectively. The bottom ends of the two V-shaped openings are opposite and spaced by a certain distance. An included angle of the V-shaped openings is between 60 degrees and 80 degrees.

As an improvement scheme, the connector is formed by a plurality of dotted slices which are spaced mutually.

As an improvement scheme, the accommodating loops and the connector are in one-off connection.

As an improvement scheme, the accommodating portion surrounds the circumference of the transition portion and closes up.

As an improvement scheme, the two ends of the accommodating portion are in smooth transition.

As an improvement scheme, the working portion of the screwdriver head is provided with a local clamping position that is connected with the transition portion. The clamping portion is provided with an alternative working end which is located at the tail end of the clamping portion, so that the working portion and the clamping portion can be mutually exchanged.

As an improvement scheme, the internal surfaces of the accommodating loops are closely adhered to the accommodating portions, the accommodating loops are relatively fixed to the corresponding accommodating portions thereof, and the external surfaces of the accommodating loops are flushed with the external surface of the clamping portion.

As an improvement scheme, all of the screwdriver heads have the same size and the same shape.

DETAILED DESCRIPTION

Figure 1:
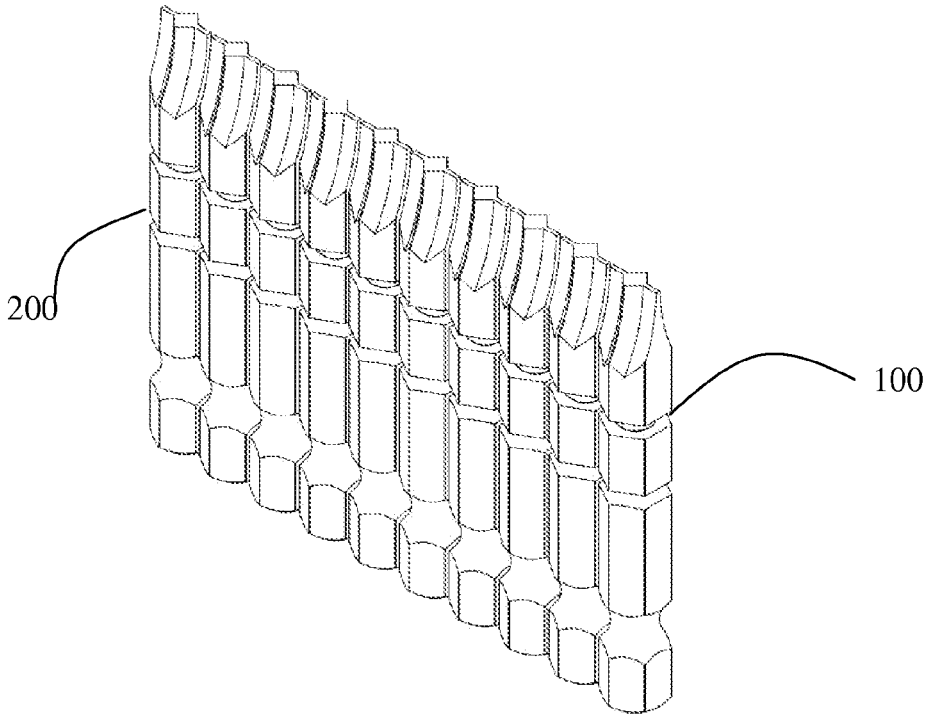
FIG. 1 is a perspective view of a combined screwdriver head accommodating device provided by one embodiment of the patent application.
Figure 2:
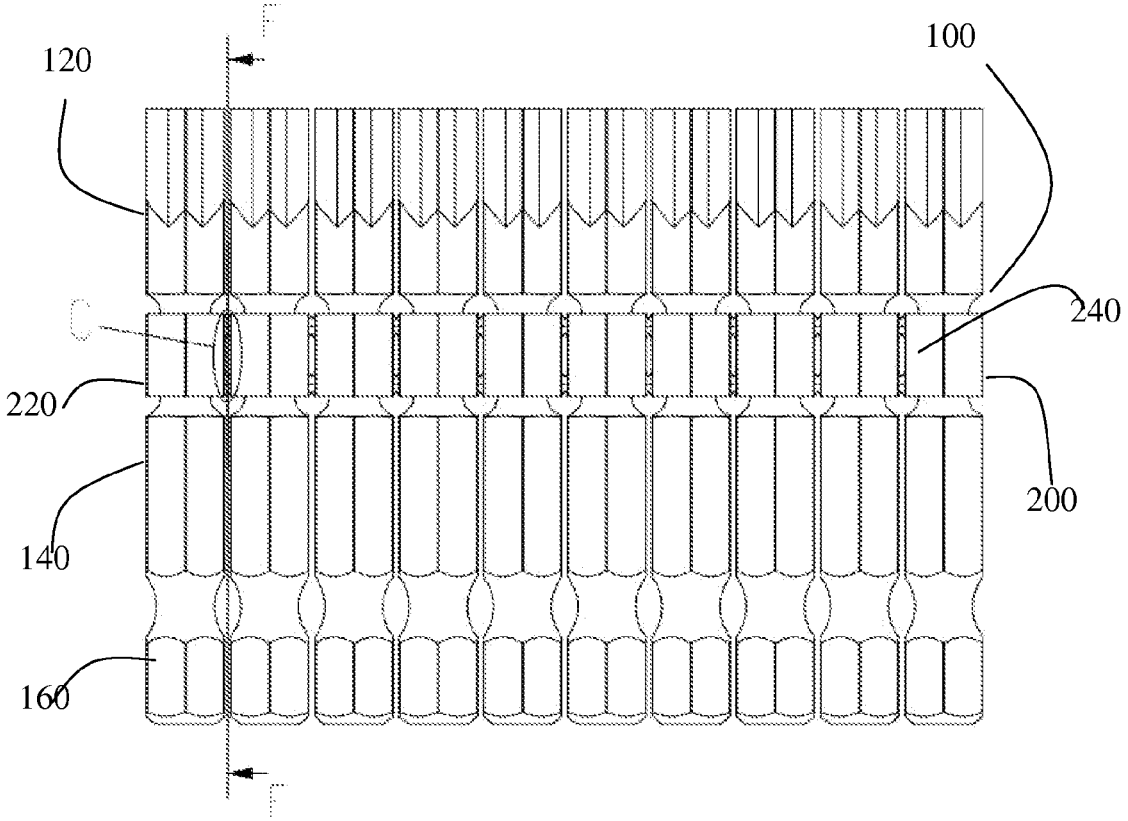
FIG. 2 is a front view of the combined screwdriver head accommodating device illustrated in FIG. 1.
Figure 3:
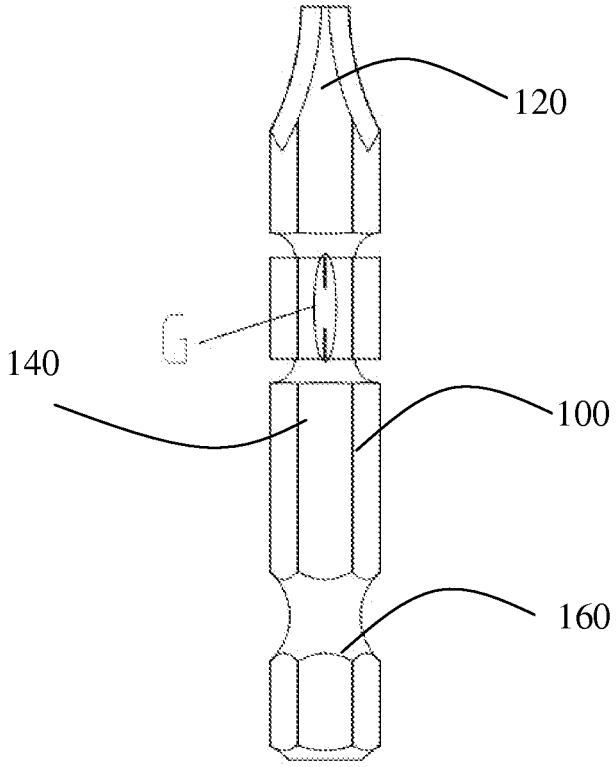
FIG. 3 is an F-F sectional view of FIG. 2.
Figure 4:
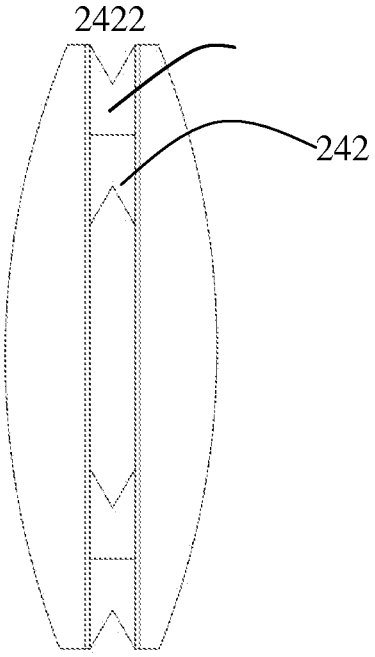
FIG. 4 is an enlarged view of an area C illustrated in FIG. 2.
Figure 5:
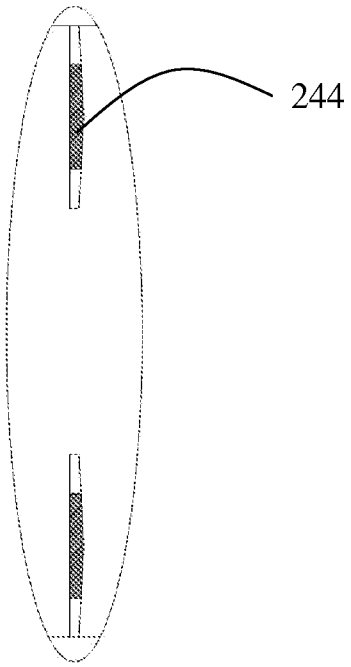
FIG. 5 is an enlarged view of an area G illustrated in FIG. 3.
Figure 6:
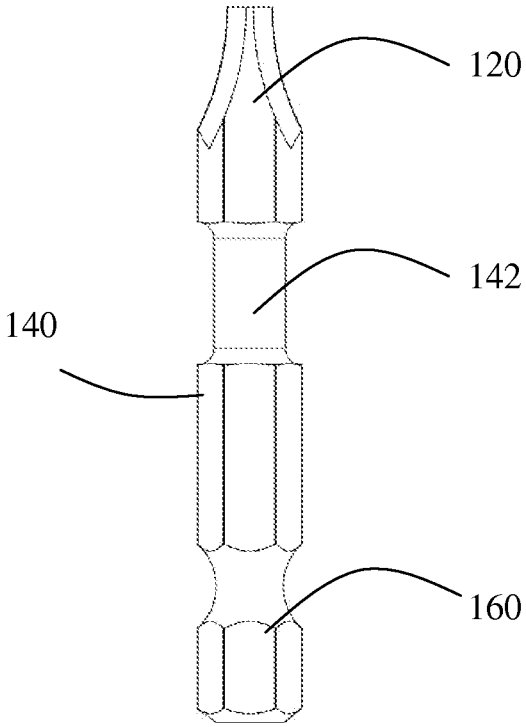
FIG. 6 is a schematic diagram of one independent screwdriver head of the combined screwdriver heads illustrated in FIG. 1 from which the accommodating loop is removed.

With reference to FIG. 1 to FIG. 6, a combined screwdriver head accommodating device provided by a preferred embodiment of the invention mainly comprises two parts, which namely include a plurality of independent screwdriver heads 100 and an accommodating device 200 connecting the plurality of independent screwdriver heads. The independent screwdriver head 100 comprises a working portion 120, a clamping portion 160 and a transition portion 140. The working portion 120 refers to the top end portion of the screwdriver head molded in a fixed shape and specification, such as a slotted shape, a hexagonal shape, a plum head, a triangular shape, a square shape, a Y shape and a U shape, etc. For convenient illustration, all the screwdriver heads used in the drawings of this embodiment are in a square shape, which are used only to illustrate, but not intended to limit the scope of the patent application. The combined screwdriver head accommodating device can be used for screwdriver heads of any shape during practical application. The surface of the transition portion 140 is provided with a section of recessed accommodating portion 142 accommodated by the accommodating device 200. In a preferred embodiment, the accommodating portion surrounds the circumference of the transition portion 140 and closes up. The accommodating portion 142 is configured to be installed in the accommodating device 200. The two ends of the accommodating portion 142 are in smooth transition to reduce a stress, so that the screwdriver head is not easy to be damaged. To facilitate unified specification and easy production, as a preferred scheme, all independent screwdriver heads 100 in one combined screwdriver head accommodating device have the same size and the same shape.

The accommodating device 200 comprises two parts, wherein one refers to a plurality of accommodating loops 220 surrounding the periphery of the accommodating portion 142 of each independent screwdriver head 100, and the other refers to a connector 240 connecting two adjacent accommodating loops. The internal surface of the accommodating loop 220 is closely adhered to the accommodating portion 142, and the accommodating loop 220 is relatively fixed to the accommodating portion 142, and cannot move. The outer diameter of the accommodating loop 220 does not exceed the outer diameter of the screwdriver head 100, so as to avoid interfering with the use and installation of the screwdriver head 100.

Preferably, the external surface of the accommodating loop 220 is flushed with the external surface of the clamping portion 160. To be specific, the longitudinal profiles of the independent screwdriver heads 100 after being coated and formed are kept consistent. Every two adjacent accommodating loops 220 are connected by the connector 240. The width (that is, the distance between every two adjacent screwdriver heads) of the connector is about 0.4-0.8 mm, and is preferably 0.5 mm. The connector 240 comprises a plurality of slices 242. The slices 242 are preferably made of soft materials having certain elasticity. Every two slices are spaced by a certain distance. In this implementation scheme, two opposite edges of a non-connecting part of each slice 242 are provided inwardly with a V-shaped opening 2422 respectively, and the bottom ends of the two V-shaped openings of each slice are opposite and spaced by a certain distance. The V-shaped opening 2422 is set to make the stress on the portion concentrated, convenient and easier to tear. An included angle of the V-shaped opening 2422 is approximately between 50 degrees and 70 degrees, and is preferably 60 degrees around. As a preferred scheme, the accommodating loops and the connector can be integrally formed by using the same material; moreover, a soft plastic coating and molding technique may be used, but is not limited to, as a manufacturing method thereof. In the embodiments illustrated in FIG. 1-FIG. 6, the connector 240 consists of two slices 242 which are respectively located close to the top and the bottom of the connector. Certainly, in other embodiments, the connector may also consist of a single slice or consist of more than two slices.

As an optional scheme, the connector may be formed by a plurality of round dotted slices which are spaced mutually (not shown in the figures).

According to the accommodating device having the slice-type connector provided by the patent application, the integrality of the screwdriver head provided by the invention may be maintained during packaging, transportation, selling and storage period, so that the screwdriver head is easier to store.

Figure 7:
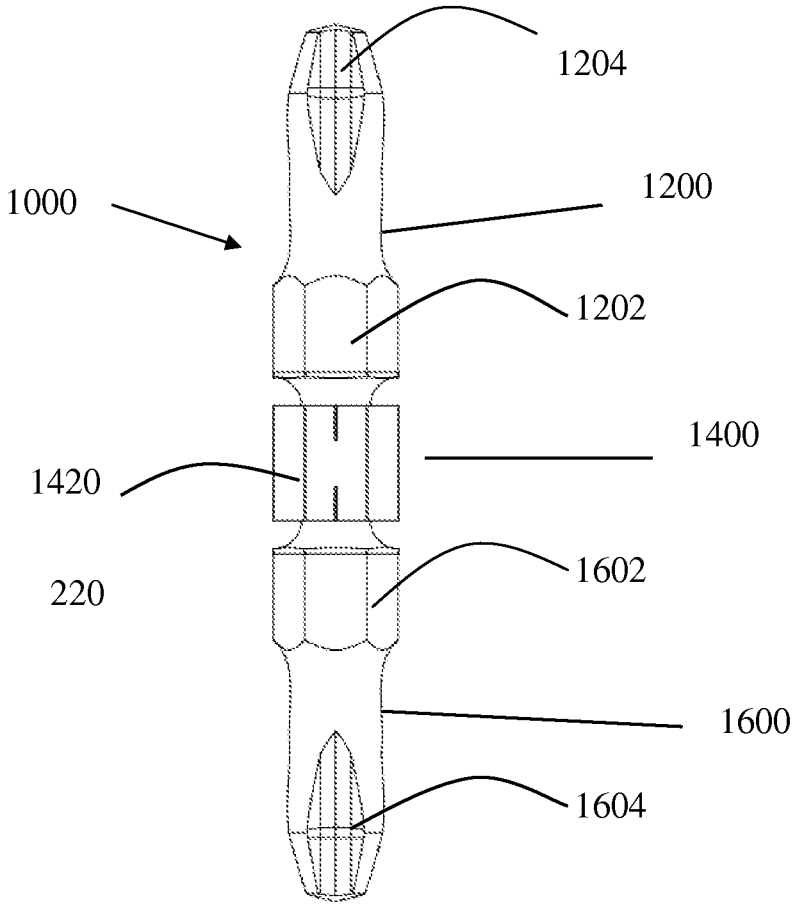
FIG. 7 shows an independent screwdriver head having an accommodating loop in another embodiment.

FIG. 7 is a schematic diagram of a double-head screwdriver head 1000 provided by the invention which comprises a first end portion 1200, a second end portion 1600 and a transition portion 1400 connecting the first end portion and the second end portion. Both the first end portion 1200 and the second end portion 1600 may be used as the working portion or the clamping portion. When the first end portion is used as the working portion, the second end portion is used as the clamping portion. When the second end portion is used as the working portion, the first end portion is used as the clamping portion. In the embodiment illustrated in FIG. 7, the first end portion 1200 is provided with a local clamping position 1202. The second end portion 1600 is provided with a local clamping position 1602. The local clamping position 1202 of the first end portion and the local clamping position 1602 of the second end portion are connected with the transition portion 1400 respectively. The first end portion 1200 is provided with a work position 1204 connected with the local clamping position 1202. The second end portion 1600 is provided with a work position 1604 connected with the local clamping position 1602. The transition portion is provided with an accommodating portion 1420 recessed inwardly along a radial direction, and configured for installing the accommodating loop 220 of the accommodating device 200 of the patent application. Such a configuration makes the clamping portion completely the same as the working portion. That is, the shapes and functions of the two ends of the independent screwdriver head 1000 are totally the same. A user may take any one of the two ends as the working portion and take the other end as the clamping portion. Such a double-head screwdriver head saves the material and avoids wasting. When one end is worn seriously, the independent screwdriver head 1000 may be reversed, so that the other end may be continuously served as the working portion to work.

Figure 8:
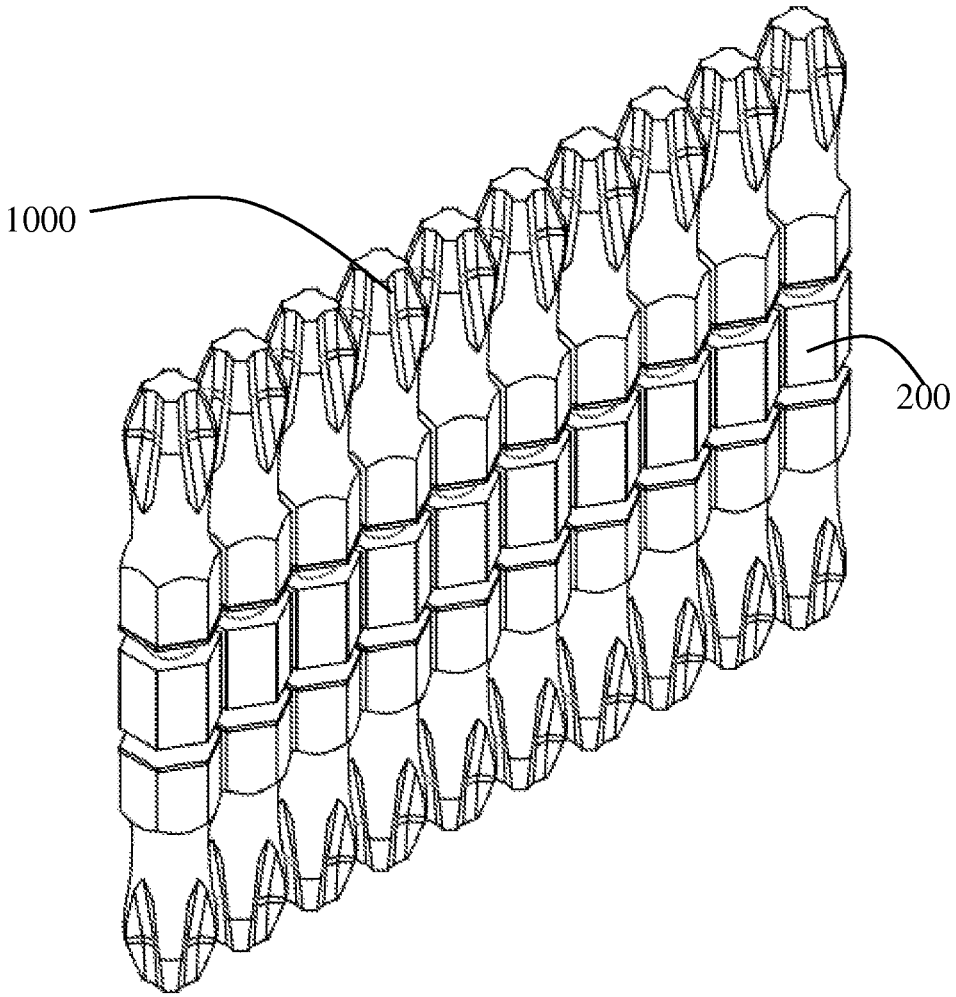
FIG. 8 is a perspective view of the combined screwdriver head accommodating device comprising the independent screwdriver head illustrated in FIG. 7.

For the combined screwdriver head formed by the above independent screwdriver heads 1000, see FIG. 8. It can be seen from FIG. 7 and FIG. 8 that a plurality of foregoing double-head screwdriver heads are arranged in one line or one row orderly through an accommodating device 200; the accommodating device 200 is the same as the accommodating devices in the embodiments illustrated in FIG. 1-FIG. 6 structurally, and comprises a plurality of accommodating loops 220 surrounding the periphery of the accommodating portion 1420 of each independent screwdriver head 1000 and a connector 240 connecting two adjacent accommodating loops.

As an option, the working positions of the two end portions of the foregoing double-head screwdriver head may be different, for example, but not limited to that the working position at one end is in a slotted shape and the working position at the other end is in a plum shape, and the like.

When the user needs to take down one independent screwdriver head, an independent screwdriver head can be obtained by only tearing the outermost connector 240. The independent screwdriver head is still provided with a corresponding accommodating loop 220 thereof. Since the accommodating loop 220 is relatively fixed to the accommodating portion, and the longitudinal profiles of the independent screwdriver heads after being coated and formed are kept consistent, the independent screwdriver head having the corresponding accommodating loop 220 thereof will not have effect on installation of an air screwdriver or an electric screwdriver.

Such belt or row package can adequately meet the demands of the user. One accommodating device is equipped with a plurality of independent screwdriver heads having the same size and the same shape. When a certain kind of screwdriver head is needed, the user may tear the screwdriver head from the entire accommodating device, and take the torn screwdriver head as a used one; in this way, it is easy to tell which one is new and which one is used.

On the premise of not departing from the concept of the present invention, those skilled in the art may make a variety of modifications and improvements, which shall all fall into the protection scope of the present invention. Therefore, the protection scope of the present invention shall be subject to the accompanying claims.

What is claimed is:

1. A combined screwdriver head accommodating device, comprising at least two screwdriver heads and an accommodating device used for accommodating the screwdriver heads, wherein the screwdriver head comprises a working portion, a transition portion and a clamping portion; two ends of the transition portion are connected with the working portion and the clamping portion respectively; the transition portion is provided with an accommodating portion recessed inwardly along a radial direction; the accommodating device comprises at least two accommodating loops and a connector for connecting the at least two accommodating loops; wherein each of the accommodating loops is adapted for mounting at the accommodating portion of each of the screwdriver head;

wherein internal surfaces of the accommodating loops are closely adhered to the accommodating portions; the accommodating loops are relatively fixed to corresponding accommodating portions thereof; and external surfaces of the accommodating loops are flushed with an external surface of the clamping portion.

2. The combined screwdriver head accommodating device according to claim 1, wherein the connector is formed by a plurality of slices which are spaced mutually apart; and two opposite edges of a non-connecting part of each slice are provided inwardly with a V-shaped opening respectively, and bottom ends of the V-shaped openings are opposite to and spaced from each other by a certain distance.

3. The combined screwdriver head accommodating device according to claim 2, wherein an included angle of the V-shaped opening is between 60 degrees and 80 degrees.

4. The combined screwdriver head accommodating device according to claim 1, wherein the connector is formed by a plurality of round dotted slices which are spaced mutually apart.

5. The combined screwdriver head accommodating device according to claim 1, wherein the working portion of the screwdriver head is provided with a local clamping position that is connected with the transition portion; the clamping portion is provided with an alternative working end; and the alternative working end is located at one end of the clamping portion.

6. The combined screwdriver head accommodating device according to claim 1, wherein the accommodating portion surrounds a circumference of the transition portion and closes up.

7. The combined screwdriver head accommodating device according to claim 1, wherein the both ends of the accommodating portion are in smooth transition.

8. The combined screwdriver head accommodating device according to claim 1, wherein all the screwdriver heads have same size and same shape.

* * * * *